US008876383B2

(12) United States Patent
Doll et al.

(10) Patent No.: US 8,876,383 B2
(45) Date of Patent: Nov. 4, 2014

(54) FLEXIBLE PACKAGES HAVING MULTIPLE LINES OF WEAKNESS TO FACILITATE OPENING

(75) Inventors: Paul Edward Doll, Madison, WI (US); Kofi Ampadu, Pittsburgh, PA (US)

(73) Assignee: Kraft Foods Group Brands LLC, Northfield, IL (US)

( * ) Notice: Subject to any disclaimer, the term of this patent is extended or adjusted under 35 U.S.C. 154(b) by 75 days.

(21) Appl. No.: 13/442,760

(22) Filed: Apr. 9, 2012

(65) Prior Publication Data

US 2013/0266244 A1 Oct. 10, 2013

(51) Int. Cl.
*B65D 33/00* (2006.01)
*B65D 30/08* (2006.01)

(52) U.S. Cl.
USPC ..... 383/209; 383/207; 383/109

(58) Field of Classification Search
CPC ..... B65D 75/5805
USPC ..... 383/207–209, 109, 116, 105; 229/87.05
See application file for complete search history.

(56) References Cited

U.S. PATENT DOCUMENTS

| | | | |
|---|---|---|---|
| 673,417 | A | 5/1901 | Brown |
| 4,008,849 | A | 2/1977 | Baber |
| 4,415,082 | A | 11/1983 | Martin |
| 5,865,367 | A | 2/1999 | Benham |
| 6,355,286 | B2 | 3/2002 | Deering et al. |
| 6,964,520 | B1 | 11/2005 | Sakai et al. |
| 7,789,291 | B2 | 9/2010 | Andersson et al. |
| 2003/0215165 | A1 | 11/2003 | Hogan et al. |
| 2005/0226542 | A1 | 10/2005 | Kendall et al. |
| 2008/0285896 | A1 | 11/2008 | Taheri |
| 2009/0161995 | A1 | 6/2009 | Henderson et al. |

FOREIGN PATENT DOCUMENTS

| | | | | | |
|---|---|---|---|---|---|
| EP | 0 596 747 | A1 | | 5/1994 | |
| EP | 1 988 021 | A2 | | 11/2008 | |
| JP | 08324597 | A | * | 12/1996 | ..... B65D 33/36 |
| JP | 11091802 | A | * | 4/1999 | ..... B65D 33/00 |
| JP | 2000 118567 | A | | 4/2000 | |
| JP | 2001225851 | A | * | 8/2001 | ..... B65D 33/00 |
| JP | 2001287767 | A | * | 10/2001 | ..... B65D 65/28 |
| JP | 2002255230 | A | * | 9/2002 | ..... B65D 65/40 |
| JP | 2011 015656 | A | | 1/2011 | |

OTHER PUBLICATIONS

International Search Report and Written Opinion of the International Searching Authority dated Aug. 14, 2013 in International Application No. PCT/US2013/035113 (12 pages).

* cited by examiner

*Primary Examiner* — Jes F Pascua
(74) *Attorney, Agent, or Firm* — Fitch, Even, Tabin & Flannery LLP

(57) ABSTRACT

A flexible film package for storing food products comprises a body with a side wall, a closed bottom end, and a closed top end. The body includes a primary line of weakness and a pair of secondary lines of weakness formed in the side wall. Each of the primary and secondary lines of weakness includes a plurality of score lines spaced apart by non-scored portions of the side wall. The score lines of the primary line of weakness have a greater length, width, and depth than the score lines of the secondary lines of weakness. The non-scored portions between the score lines of the primary line of weakness are longer than the non-scored portions between the score lines of the secondary lines of weakness.

19 Claims, 6 Drawing Sheets

FLEXIBLE PACKAGES HAVING MULTIPLE LINES OF WEAKNESS TO FACILITATE OPENING

FIELD

Flexible film packages for food items, and in particular, flexible film packages having lines of weakness for facilitating the opening of the packages and dispensing of the food contents are described herein.

BACKGROUND

Food items are routinely sold in sealed plastic packages. The packages are typically made by vertical-form-fill-and-seal devices such that a web of flexible film material, is formed into a tube. This tube is sealed on one end and then filled with the package contents. The second end is then also cut and sealed to seal the contents of the package therein and then singulated. To open such a package and access the food item, a consumer can tear off and remove a portion of the package. In certain packages, such as stick-pack packages, it can be advantageous to completely remove an end of the package including the end seal to allow for the contents to be dispensed into a suitable container, for example, a cup.

Flexible film packages include various features to assist the consumer in opening the package. Some packages include a weakening of the package material along a given line such that a tear can propagate along that line when a user opens the package. A disadvantage of such packages is that the tear does not always follow the weakened line. Instead, the tear can deviate from the desired propagation path delineated by the weakened line.

It is known to make the weakened lines in the packages using a laser. The laser can ablate the package material along a line across the package without cutting entirely through the package material. Frequently, the package is so weakened by the laser scoring that the package loses its structural integrity and does not stay intact during its vertical-form-fill-and-seal manufacturing process, and sometimes even during normal handling by a user before the package is intended to be opened. In packages where the laser scoring is less deep to preserve the tensile strength of the package, the score line can be less pronounced in the side wall and can be difficult for a user to see. To make a laser score more visible for a consumer, printing indicia on the package can highlight the laser score. For example, the package may have the words "TEAR. HERE" and an arrow pointing to the laser score printed thereon. However, when the laser score is applied after printing, alignment of the indicia and the laser score line may not coincide.

SUMMARY

A flexible film package is provided. The flexible film package includes a body having a bottom end including a bottom seal, a top end including a top seal, a longitudinal axis passing through the top and bottom ends, and a side wall, connecting the top and bottom ends and enclosing an interior including a food product. The package further includes a primary line of weakness and a pair of spaced, substantially parallel secondary lines of weakness formed in the side wall. The primary line of weakness is between and substantially parallel to the secondary lines of weakness. The primary line of weakness includes a plurality of score lines spaced apart by non-scored portions of the side wall. Each secondary line of weakness includes a plurality of score lines spaced apart by non-scored portions of the side wall. Each of the non-scored portions has a length and each of the score lines have a length, width, and a depth. Each of the non-scored portions between the score lines of the primary line of weakness has a greater length than the non-scored portions of the side wall between the score lines of the secondary lines of weakness. Each of the score lines of the primary line of weakness has at least one of a greater length, width, and depth than each of the score lines of the secondary lines weakness. The primary line of weakness is configured to propagate a tear through the side wall. At least one of the secondary lines of weakness is configured to propagate the tear through the side wall if the tear deviates from the primary line of weakness.

The package can have at least one tertiary line of weakness formed in the side wall above one of the secondary lines of weakness and at least another tertiary line of weakness formed in the side wall below the other of the secondary lines of weakness. The side wall can have a first side edge and a second side edge opposite the first side edge, and at least one of the score lines of the primary line of weakness can intersect at least one of the first and second side edges. The package can further include a fin seal extending along the longitudinal axis between the top seal and the bottom seal such that at least one of the score lines of the primary line of weakness can intersect at least a portion of lee fin seal. The package can further include a plurality of fold lines in the side wall about which the package is folded such that at least one of the score lines of the primary line of weakness can intersect at least one of the told lines.

A method of manufacturing the flexible film package is provided. The method includes providing a flexible film material; scoring the primary line of weakness across at least a portion of the side wall; scoring one of the secondary lines of weakness across at least a portion of the film material and above the primary line of weakness; scoring another of the secondary lines of weakness across at least a portion of the film material and below the primary line of weakness; forming the film material into a tube; sealing the bottom end of the tube; filling the tube with the food product; sealing the top end of the tube; and singulating the package from the flexible film material.

A method of opening the flexible film package is provided. The method includes initiating a tear line in the side wall of the package; propagating the tear line along the primary line of weakness across at least a portion of the side wall of the package; propagating the tear line along one of the secondary lines of weakness across at least a portion of the side wall of the package if the tear line deviates from the primary line of weakness; separating at least a portion of the top seal from the side wall of the package to gain access to the food product in the interior; and dispensing the food product from the package.

DETAILED DESCRIPTION

A flexible film package as described, herein includes a primary line of weakness and a pair of secondary lines of weakness to facilitate the opening of the package. The primary line of weakness is indicated in the side wall of the package in a more visible manner than the secondary lines of weakness, such as in a color contrasting with the color of the side wall such that the primary line of weakness is clearly visible on the package to the consumer. While the secondary lines of weakness may also be visible to the consumer, they are much less pronounced in the side wall of the package such that even in the absence of a "TEAR HERE" instruction, it can be apparent to the consumer that the tear should be initiated proximate the primary line of weakness.

The package may contain foodstuffs such as drink powders, dessert powders, snack nuts, condiments, and toppings that can be dispensed into a suitable container or directly into a consumer's mouth. A consumer can open the package by tearing the package along the package's primary line of weakness. If the tear deviates from the primary line of weakness, the tear can propagate along one of the secondary lines of weakness across the package, ensuring a controlled and predictable pattern for an end of the package to be easily and completely removed to allow the consumer to access the foodstuff contained in the package. The primary line of weakness and the secondary lines of weakness can be formed by a laser in a pattern that allows the consumer to easily see the intended tear line and provides the film material with increased tensile strength so as to avoid breaking during the conventional vertical-form-fill-and-seal process.

Figure 1:
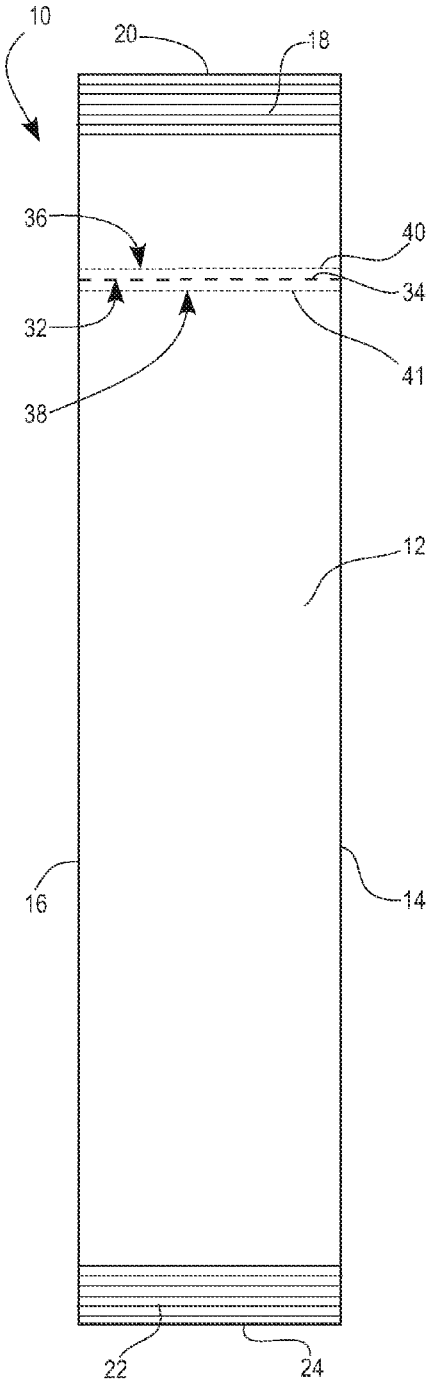
FIG. 1 is a side elevational view of an exemplary package having multiple lines of weakness.
Figure 2:
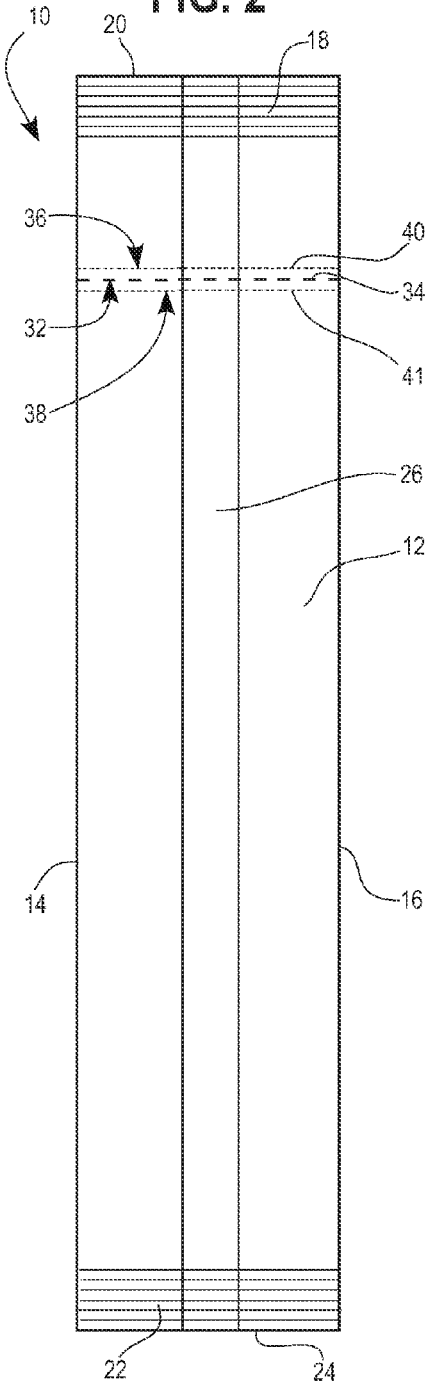
FIG. 2 is side elevational view showing the opposite side and the fin seal of the package of FIG. 1.
Figure 3:
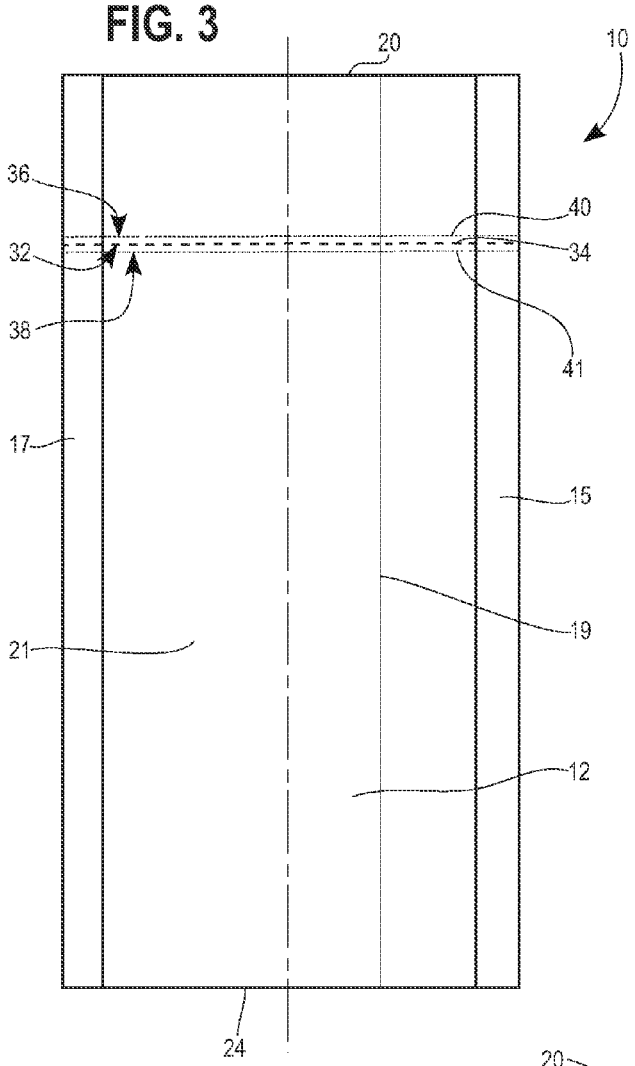
FIG. 3 is a plan view of the film material from which the package of FIG. 1 is formed.

With reference to FIGS. 1-3, a package 10 has an elongate body including a side wall 12 with a first side edge portion 14 and a second side edge portion 16 opposite the first side edge portion 14. The side wall 12 encloses an interior of the package 10 where a food product 30 can be stored. The package 10 includes a top seal 18 at a top end 20 of the package 10 and a bottom seal 22 at a bottom end 24 of the package 10. The side wall 12 of the package 10 includes seal areas 15 and 17 along the first and second side edge portions 14 and 16, respectively, as shown in FIG. 3.

With reference to FIG. 3, the side wall 12 of the package 10 can be folded about the fold lines 19 and 21 to bring the seal areas 15 and 17 together and form a fin seal 26. The fin seal 26 can extend in a direction along the longitudinal axis of the package 10 and may connect the top and bottom seals 18 and 22. Any of the above-described seals may be made by conventional methods, including, for example, the application of heat and pressure to create a laminate seal. When sealed by such seals, a food product in the interior of package 10 is protected from outside elements such as moisture and oxygen.

With further reference to FIGS. 1-3, the package 10 also includes multiple lines of weakness extending across at least a portion of the side wall 12 of the package 10. A primary line of weakness 32 includes a series of ablated portions or score lines 34. An upper secondary line or weakness 36 extends across at least a portion of the side wall 12 of the package 10 above the primary line of weakness 32. A lower secondary line of weakness 38 extends across at least a portion of the side wall 12 of the package 10 below the primary line of weakness 32. The secondary lines of weakness 36 and 38 include a series of ablated portions or score lines 40 and 41, respectively.

The secondary lines of weakness 36 and 38 can be parallel to each other and to the primary line of weakness 32, as shown in FIG. 1. Alternatively, the secondary lines of weakness 36 and 38 can converge or diverge relative to each other or relative to the primary line of weakness 32. Further, while the primary line of weakness 32 and the secondary lines of weakness 36 and 38 have been shown as being perpendicular to the longitudinal axis of the package 10, any one or all of the lines of weakness may be inclined at various angles to the longitudinal axis. Moreover, while the primary line of weakness 32 and the secondary lines of weakness 36 and 38 have been shown as being straight, the lines of weakness 32, 36, and 38 may be curved (e.g., convex, concave, undulating, etc.).

Figure 5:
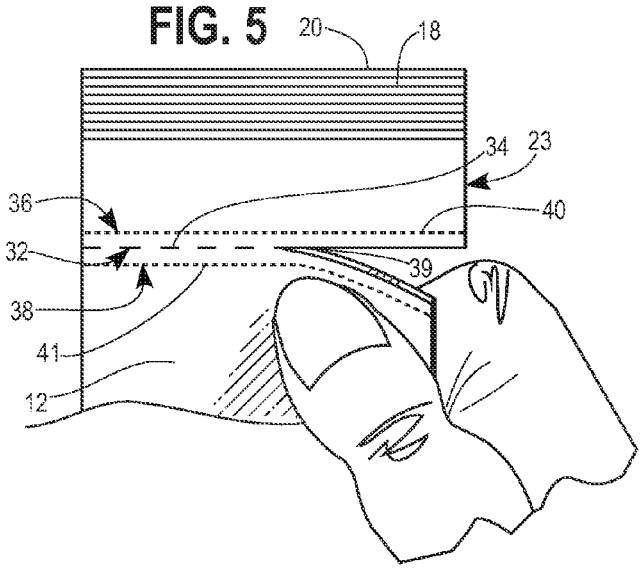
FIG. 5 is the same view as in FIG. 4, shown with a user's fingers applying a tearing force and propagating a tear line through the primary line of weakness of the package.
Figure 6:
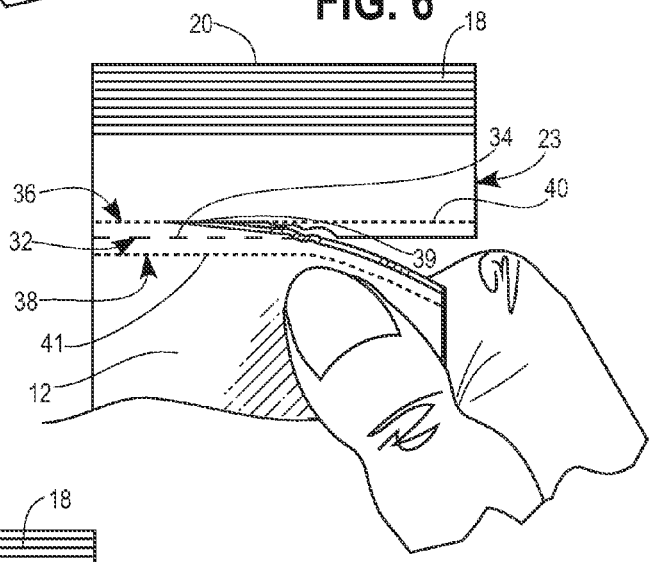
FIG. 6 is the same view as in FIG. 5, shown with a portion of the tear line deviating from the primary line of weakness and propagating along the secondary line of weakness that is above the primary line of weakness.
Figure 7:
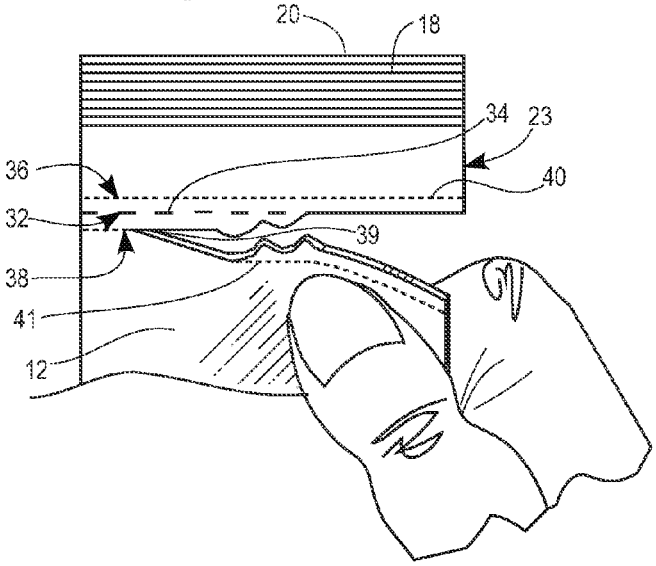
FIG. 7 is the same view as in FIG. 5, shown with a portion of the tear line deviating from the primary line of weakness and propagating along the secondary line of weakness that is below the primary line of weakness.

With reference to FIGS. 5-7, the package 10 includes a removable portion 23 formed in the side wall 12. The removable portion 23 may be separated from the package 10 along the primary line of weakness 32, or along either one of the secondary lines of weakness 36 and 38. The removable portion 23 provides an access opening for dispensing the contents as well as a tamper-evident feature.

Figure 4:
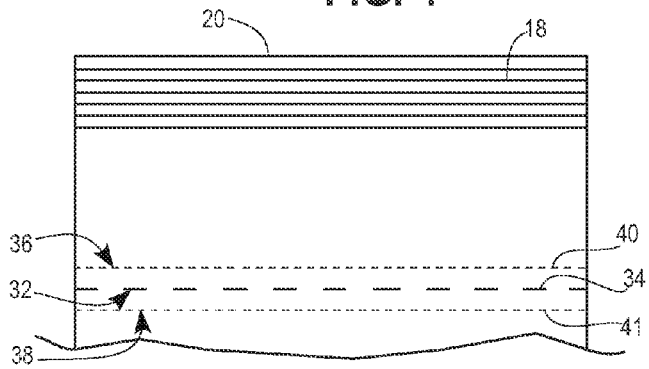
FIG. 4 is an enlarged fragmentary view of a portion of the package of FIG. 1 including the lines of weakness and an end seal.

The primary line of weakness 32 defines an intended path of a tear line 39 across the sidewall 12 of the package 10, as shown in FIG. 5. As shown in FIG. 4, one score line 34 of the primary line of weakness 32 can intersect the first side edge 14 of the package 10 and another score line 34 of the primary line of weakness 32 can intersect, the second side edge 16 of the package 10. The intersection of the score lines 34 of the primary line of weakness 32 with the side-edges 14 and 16 allows the user to easily initiate a tear along the tear line 39, as shown in FIG. 5. Alternatively, the package 10 may include a tear notch (not shown) aligned with the primary line of weakness 32. The tear notch could extend completely or partially through the side wall of the package 10. The tear notch could provide a tear initiation site that facilitates the separation of the removable portion 23 from the package 10 along the primary line of weakness 2.

With reference to FIG. 5, to open the package 10, the consumer can grasp the package 10 and apply a force to initiate a tear in the side wall 12 at the intersection of the score line 34 with the side edge 14. A tear line 39 can then be formed which follows along a path delineated by the score lines 34 of the primary line of weakness 32. The tear line 39 can separate the removable portion 23, together with the top seal 18, from the rest of the package 10. The pattern of the score lines 34 and the non scored portions 44 of the primary line of weakness 32 can permit the user to separate the removable portion 23 from the package 10 without substantially deviating from the tear line 39.

As discussed herein below, the primary line 32 can have score lines 34 and non-scored portions 44 having approximately equal length. Having non-score portions 44 of such length between the scored portions 34 increases the likelihood that the tear line 39 will deviate from the primary line of weakness 32. Conversely, the lengths of the non-scored portions 49 and 50 between the score lines 40 and 41 of the secondary lines of weakness 36 and 38 are significantly smaller and increase the likelihood that the tear line 39 will propagate along one of the secondary lines of weakness 36 or 38 without deviation.

For example, during the propagation of the tear line 39 through a non-scored portion 44 of the primary line of weakness 32, the tear line 39 could deviate in a direction toward the upper secondary line of weakness 36, as shown in FIG. 6. The tear line 39 could then propagate through the side wall 12 of the package 10 until it intersects with the secondary line of weakness 36 and would follow the secondary line of weakness 36 across the side wall 12 to separate the removable portion 23 from the package 10.

Figure 8:
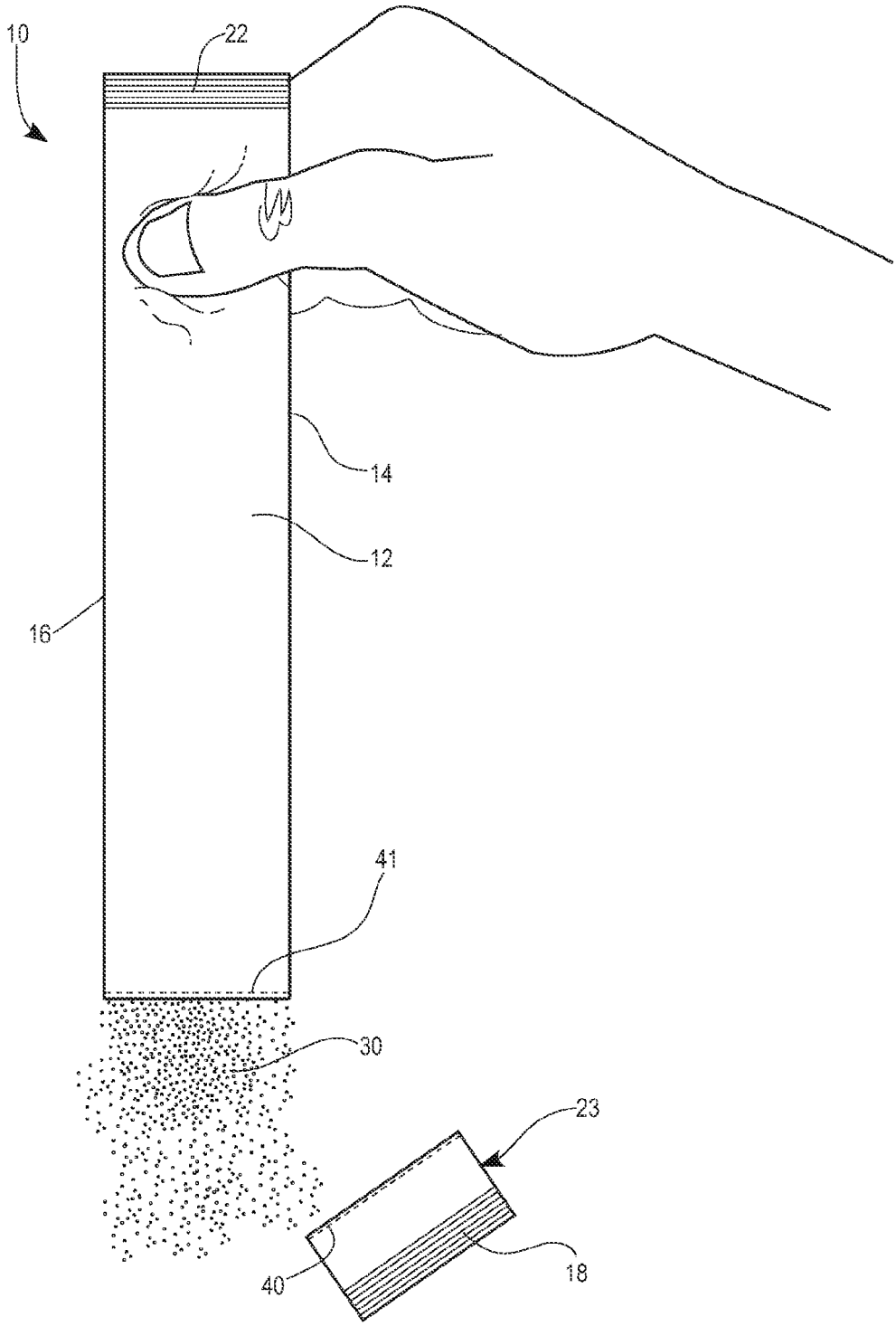
FIG. 8 is a side elevational view of the package of FIG. 1, shown with the removable portion completely separated from the package and the food product being dispensed from the package.

Alternatively, the tear line 39 could deviate in a direction toward the lower secondary line of weakness 38 and propagate through the side wall 12 of the package 10 until it intersects with the secondary line of weakness 38. As shown in FIG. 7, the tear line 39 would then follow the secondary line of weakness 38 across the package 10 to separate the removable portion 23 from the package 10. Thus, the primary line of weakness 32 and the secondary lines of weakness 36 and 38 facilitate propagation of the tear line 39 along a controlled and predictable pattern such that the removable portion 23 including the top seal 18 can be readily removed by a consumer and the food product 30 can be dispensed from the package 10, as shown in FIG. 8.

While the package 10 has been shown as having only one secondary line of weakness 36 above and one secondary line of weakness 38 below the primary line of weakness 32, the package 10 can be made with two or more secondary lines of weakness 36 and 38 formed in the side wall 12 above and/or below the primary line of weakness 32. For example, the side wall 10 may include one tertiary line of weakness above the secondary lines of weakness 36 and another tertiary line of weakness below the secondary line of weakness 38. The tertiary lines of weakness can be identical or similar to the secondary lines of weakness 36 and 38, such as in dimensions, pattern, and/or function. Alternatively, the tertiary lines of weakness may have different dimensions and/or pattern.

In this approach, if the tear line deviates upward from both the primary line of weakness 32 and the secondary line of weakness 36 located above the primary line of weakness 32, the tear line would intersect and follow a tertiary line of weakness parallel to and located above the secondary line of weakness 36. Conversely, if the tear line deviates downward from both the primary line of weakness 32 and the secondary line of weakness 38 located below the primary line of weakness 32, the tear line would intersect and follow a tertiary line of weakness parallel to and located below the secondary line of weakness 38. The package 10 may have different patterns of primary (P), secondary (S), and tertiary (T) lines of weakness. For example, the pattern could be any one of TSPST, TSPS, SPST, SPSPS, or the like.

Figure 9:
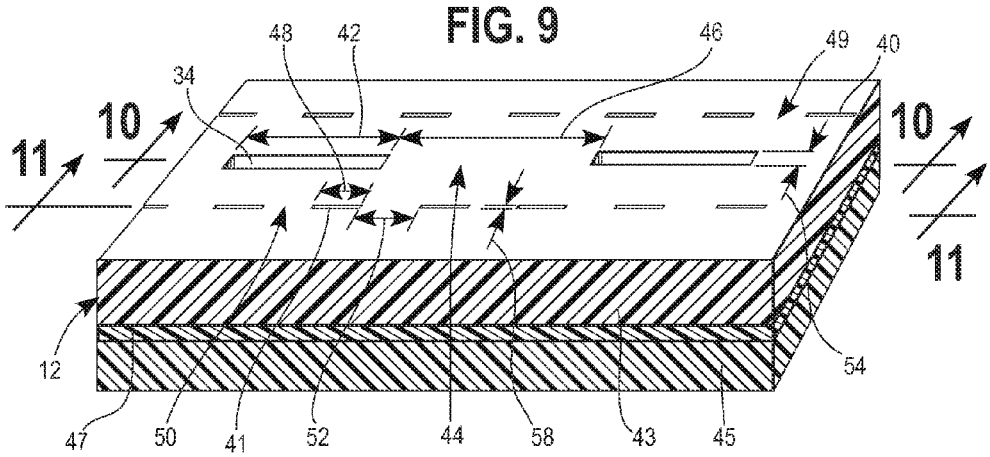
FIG. 9 is a perspective view of some of the layers of the flexible film material that can comprise the side wall of an exemplary package.
Figure 10:
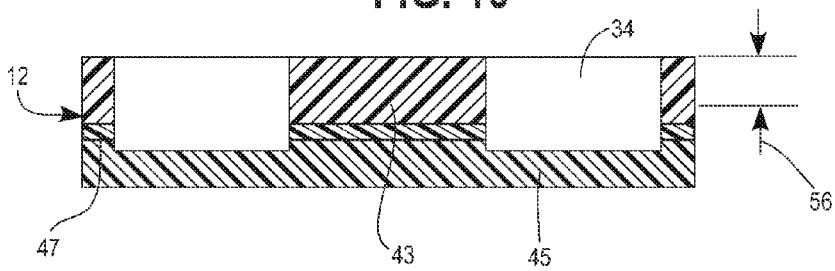
FIG. 10 is a sectional side view of a portion of the flexible film material of FIG. 9, showing the depth of the score lines of the primary line of weakness.
Figure 11:
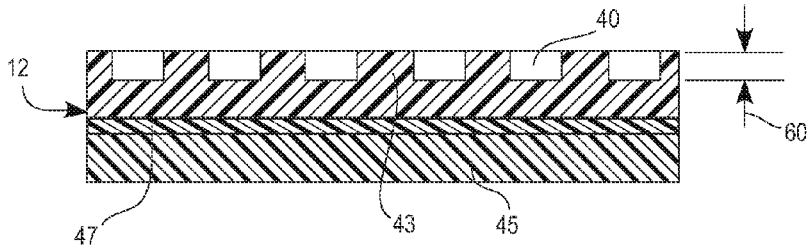
FIG. 11 is a sectional side view of a portion of the flexible film material of FIG. 9, showing the depth of the score lines of one of the secondary lines of weakness.

With reference to FIGS. 9-11, the flexible film material forming the side wall 12 can include multiple layers of material. For example, the side wall 12 can include at least an outer layer 43, an ink layer 47, and an inner layer 45. The outer layer 43 and the inner layer 45 can be made of at least one material from a group including PET (polyethylene terephthalate) and OPP (oriented polypropylene film). The ink layer 47 can be sandwiched between the outer layer 43 and the inner layer 45, and can include imprinted branding and product information. Either one or both of the inner layer 45 and outer layer 43 of the side wall 12 of the package 10 may be metalized to increase the protection of the food product 30 contained in the package 10.

It will be appreciated that the relative thickness of each of the layers 43, 45, and 47 in FIGS. 9-11 has been shown for illustration purposes only and has not been drawn to scale. Further, although only the outer layer 43, the inner layer 45, and the ink layer 47 of the side wall 12 have been shown in FIGS. 9-11, the side wall 12 can include one or more additional inner layers, for example, a foil layer, a PET and/or OPP layer, and a sealant layer. The sealant layer can be made of PE (polyethylene) or other material suitable for being in contact with the food product 30 and having suitable seal characteristics.

The score lines 34 of the primary line of weakness 32 can be about four to six millimeters in length (designated, for example, by the reference numeral 42 in FIG. 9) separated by non-ablated or non-scored portions 44 of the side wall 12, which can be from about 4 to 6 millimeters in length (designated, for example, by the reference numeral 46 in FIG. 9). The score lines 40 and 41 of the secondary lines of weakness 36 and 38 can be from about one to three millimeters in length (designated, for example, by the reference numeral 48 in FIG. 9) separated by non-ablated or non-scored portions 49 and 50 of the side wall 12, which can be from about 0.25 to about 0.75 millimeters in length (designated, for example, by the reference numeral 52 in FIG. 9).

The score lines 34 of the primary line of weakness 32 can be from about 0.4 to about 0.6 millimeters in width (designated, for example, by the reference numeral 54 in FIG. 9), and can be from about 1 to about 2 millimeters in depth (designated, for example, by the reference numeral 56 in FIG. 10). The score lines 40 and 41 of the secondary lines of weakness 36 and 38 can be from about 0.1 to about 0.3 millimeters in width (designated, for example, by the reference numeral 58 in FIG. 9), and can be from about 0.25 to about 1 millimeters in depth (designated, for example, by the reference numeral 60 in FIG. 10). While the score lines 34, 40, and 41 are shown as extending across the entire package 10, they can extend across a shorter length and/or different relative lengths.

The score lines 34 of the primary line of weakness 32 and the score lines 40 and 41 of the secondary lines of weakness 36 and 38 can be scribed with one or more lasers in the flexible film material from which the package 10 is made. A carbon dioxide laser or another suitable laser may be used to scribe the score lines 34, 40, and 41 in the side wall 12 of the package 10.

With reference to FIGS. 10 and 11, the depth of the score lines 40 and 41 of the secondary lines of weakness 36 and 38 can be less than the depth of the score lines 34 of the primary line of weakness 32, and the depth of the score lines 34 of the primary line of weakness 32 can be greater than the thickness of the outer layer 43. In particular, the depth of the score lines 34 of the primary line of weakness 32 can be greater than the depth of the outer layer 43, but less than the combined, depth of the outer layer 43 and the inner layer 45. The score lines 34 can pass through the outer layer 43, the ink layer 47, and a portion of the inner layer 45 to provide the package 10 with a primary line or weakness 32 that is clearly visible to the consumer. For example, the outer layer 43 may be transparent, the ink layer 47 may be orange, and the inner layer 45 may be white such that the score lines 34 passing through the outer layer 43, the ink layer 47, and a portion of the inner layer 45 would result in a white primary line of weakness 32 that would be highly visible on the orange-colored side wall 12. It is to be appreciated that the inner layer 45 and the ink layer 47 may of any suitable colors, including colors that are selected due to their high contrast relative one another.

In another approach, the score lines 34 of the primary line of weakness 32 may have a depth that is less than a thickness of the outer layer 43 of the side wall 12 of the package 10. Furthermore, although the score lines 34, 40, and 41 have been shown as passing through the outer layer 43, the ink layer 7, and a portion of the inner layer 45, the score lines 34, 40, and 41 may alternatively pass through the inner layer 45, the ink layer 47, and a portion of the outer layer 43. This approach can be achieved by laser scribing an opposite surface of the flexible film material from which the side wall 12 of the package 10 is made.

The multiple lines of weakness 32, 36, and 38 having the above-indicated dimensions do not undermine the structural integrity of the side wall 12 of the package 10 to an unsuitable degree. Instead, the pattern of the scored portions 34 and 40, 41 and the respective non-scored portions 44, 49, and 50 of the primary and secondary lines of weakness 32, 36, and 38 can provide the side wall 12 with sufficient tensile strength to remain intact during the vertical-form-fill-and-seal process as well as routine handling by a user. It will be appreciated that although the pattern of the score lines 34, 40, and 41 has been shown as being uniform, the score lines 34, 40, and 41 may have a non-uniform pattern within the length ranges for the scored and non-scored portions as taught herein.

The package 10 can have a length as measured from the top end 20 to the bottom end 24 from about 75 millimeters to about 200 millimeters, and a width as measured from the first side edge 14 to the second side edge 16 from about 15 millimeters to about 40 millimeters. It is to be appreciated that the dimensions of the package 10 and the lines of weakness 32, 36, and 38 have been provided for illustration purposes only, and that the principles of this disclosure can be utilized to provide multiple lines of weakness in flexible film packages of any size.

Figure 12:
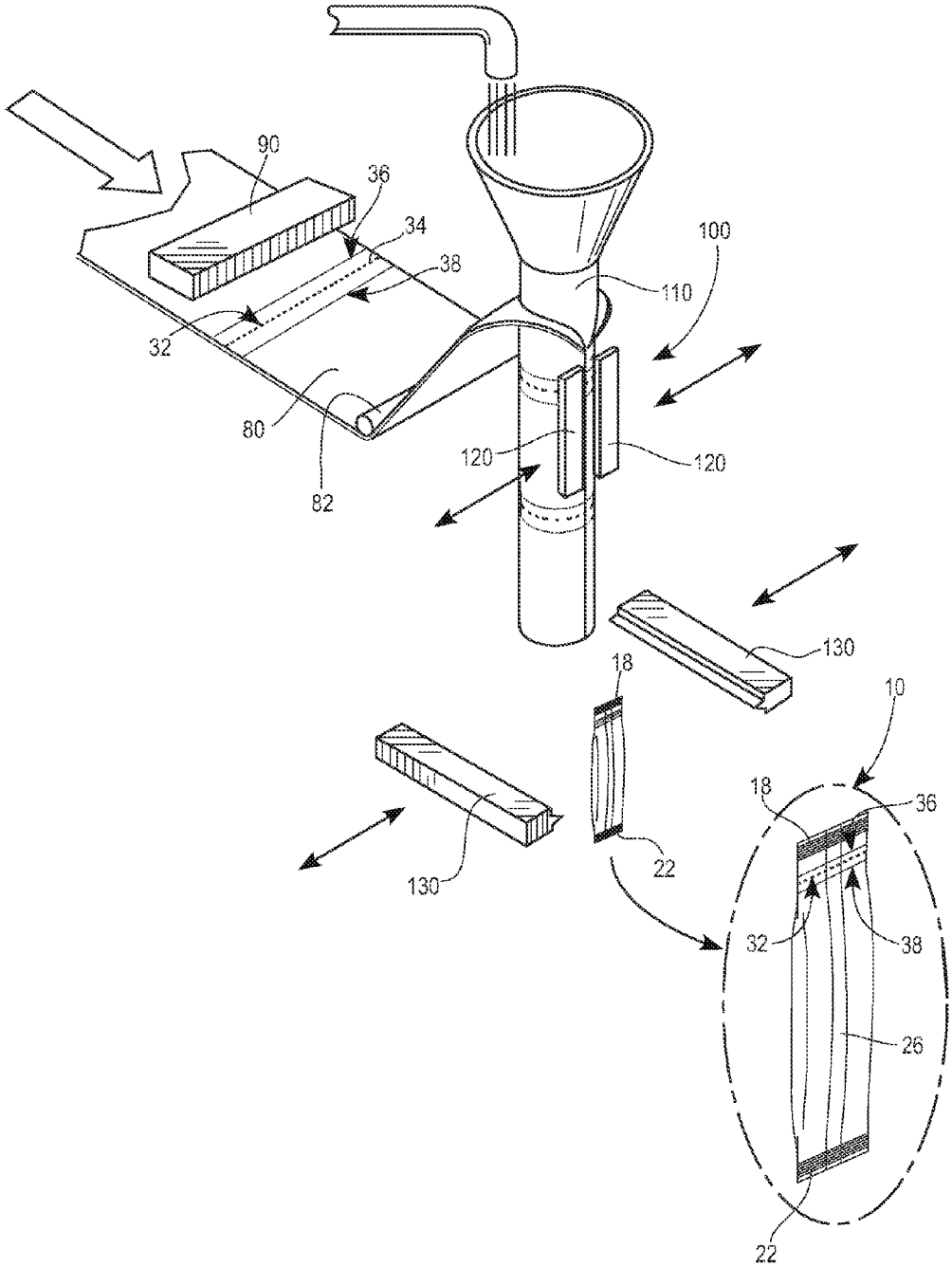
FIG. 12 is a perspective view of relevant portions of a vertical-form-fill-and-seal device during the manufacture of the package of FIG. 1.

Referring now to FIG. 12, an exemplary method for manufacturing the flexible film package 10 is shown. One or more rollers 82 can be used to feed a flexible film material 80 into and along a vertical-form-fill-and-seal device 100. A laser applicator 90 can be used to score the flexible film material 80 to form the primary line of weakness 32, the upper secondary line of weakness 86, and the lower secondary line of weakness 38. It is to be appreciated that while a laser applicator has been shown, the primary and secondary lines of weakness 32, 36, and 38 can be formed by another suitable technique, for example, micro-abrasion or a die-cut.

The primary and secondary lines of weakness 32, 36, and 38 can be formed in the flexible film material 80 prior to feeding the flexible film material 80 into the vertical-form-fill-and-seal device 100, as shown in FIG. 12. By another approach, a laser applicator may be incorporated into the vertical-form-fill-and-seal device 100 such that the primary and secondary lines of weakness 32, 36, and 38 may be added during the feeding of the flexible film material 30 through the vertical-form-fill-and-seal device 100. By yet another approach, two laser applicators may score the flexible film material 30 on two sides to form the primary and secondary lines of weakness 32, 36, and 38.

As the flexible film material 80 is being fed over a forming tube 110 of the vertical-form-fill-and-seal device 100, a portion of the flexible film material 80 generally corresponding to the sealing areas 15 and 17 of FIG. 3 can fold around the forming tube 110 and is sealed along a vertical direction by a pair of longitudinal sealing jaws 120 to form the fin seal 26. The flexible film material 80 is then sealed in a horizontal direction by a pair of transverse sealing jaws 130 to form the end seals 18 and 22. The jaws 130 can also be used to either cut or pull away the flexible film material 80 to singulate the package 10 having the primary line of weakness 32 and the secondary lines of weakness 36 and 38, as shown in FIG. 12.

So configured, the package 10 created by such a method and as otherwise described herein provides a consumer with a clearly visible starting point to tear open a package when compared to previous packages provided to the consumers. Further, the tear more reliably propagates along the tear line either along the primary line of weakness or along one of the secondary lines of weakness. Moreover, the package 10 having the primary and secondary lines of weakness 32, 36, and 38 has sufficient tensile strength to withstand both the vertical-fill-and-seal process and routine handling by a consumer.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the concept.

The invention claimed is:

1. A flexible film package containing a food product, the package comprising:

a body having a bottom end including a bottom seal, a top end including a top seal, a longitudinal axis passing through the top and bottom ends, and a side wall connecting the top and bottom ends and enclosing an interior;

a primary line of weakness formed in the side wall, the primary line of weakness including a plurality of score lines spaced apart by non-scored portions of the side wall; and a pair of spaced, substantially parallel secondary lines of weakness formed in the side wall, each secondary line of weakness including a plurality of score lines spaced apart by non-scored portions of the side wall, each of the non-scored portions between the score lines of the primary line of weakness having a greater length than each of the non-scored portions between the score lines of the secondary lines of weakness, each of the score lines of the primary line of weakness having at least one of a greater length, width, and depth than each of the score lines of the secondary lines weakness, each of the non-scored portions between the score lines of the primary line of weakness having a greater length than a combined length of at least two of the score lines of the secondary lines of weakness, the primary line of weakness being configured to propagate a tear through the side wall, at least one of the secondary lines of weakness being configured to propagate the tear through the side wall if the tear deviates from the primary line of weakness.

2. The package of claim 1, wherein the side wall has a first side edge and a second side edge opposite the first side edge, at least one of the score lines of the primary line of weakness intersecting at least one of the first and second side edges.

3. The package of claim 1, further comprising a fin seal extending along the longitudinal axis between the top seal and the bottom seal, at least one of the score lines of the primary line of weakness intersecting at least a portion of the fin seal.

4. The package of claim 1, further comprising a plurality of fold lines in the side wall about which the package is folded, at least one of the score lines of the primary line of weakness intersecting at least one of the fold lines.

5. The package of claim 1, wherein the secondary lines of weakness are on opposite sides of and equidistant from the primary line of weakness.

6. The package of claim 1, wherein the primary line of weakness is perpendicular to the longitudinal axis.

7. The package of claim 1, wherein the side wall comprises at least two layers.

8. The package of claim 7, wherein the side wall comprises an outer layer comprising at least one of polyethylene terephthalate and oriented polypropylene film, and at least one inner layer comprising at least one of polyethylene terephthalate, oriented polypropylene film, and foil.

9. The package of claim 7, wherein the depth of the score lines of the primary line of weakness is greater than a thickness of an outer layer of the package.

10. The package of claim 1, wherein the length of the score lines of the primary line of weakness is from about 4 mm to about 6 mm in length and the length of the score lines of the secondary lines of weakness is from about 1 to about 2 mm.

11. A method of manufacturing the package of claim 1, the method comprising:

providing a flexible film material;

scoring the primary line of weakness across at least a portion of the flexible film material;

scoring one of the secondary lines of weakness across at least a portion of the film material and on one side of the primary line of weakness;

scoring another of the secondary lines of weakness across at least a portion of the film material and on another side of the primary line of weakness;

forming the film material into a tube;

sealing the bottom end of the tube;

filling the tube with the food product;

sealing the top end of the tube; and singulating the package from the remainder of flexible film material.

12. A method of opening the package of claim 1, the method comprising:

initiating a tear line in the side wall of the package;

propagating the tear line along the primary line of weakness across at least a portion of the side wall of the package;

propagating the tear line along one of the secondary lines of weakness across at least a portion of the side wall of the package if the tear line deviates from the primary line of weakness;

separating at least a portion of the top seal from the side wall of the package to gain access to the food product in the interior; and dispensing the food product from the package.

13. The package of claim 1, wherein the side wall includes at least an outer layer, an inner layer, and an ink layer between the outer layer and the inner layer, and wherein the depth of the score lines of the primary line of weakness extend through the outer layer, the ink layer, and a portion of the inner layer.

14. The package of claim 1, wherein a color of the inner layer is visible on the side wall through the score lines of the primary line of weakness.

15. A flexible film package containing a food product, the package comprising:

a body having a bottom end including a bottom seal, a top end including a top seal, a longitudinal axis passing through the top and bottom ends, and a side wall connecting the top and bottom ends and enclosing an interior;

a primary line of weakness formed in the side wall, the primary line of weakness including a plurality of score lines spaced apart by non-scored portions of the side wall; and a pair of spaced, substantially parallel secondary lines of weakness formed in the side wall, each secondary line of weakness including a plurality of score lines spaced apart by non-scored portions of the side wall, each of the non-scored portions between the score lines of the primary line of weakness having a greater length than each of the non-scored portions between the score lines of the secondary lines of weakness, each of the score lines of the primary line of weakness having at least one of a greater length, width, and depth than each of the score lines of the secondary lines weakness, each of the non-scored portions between the score lines of the primary line of weakness having a greater length than a combined length of at least two of the score lines of the secondary lines of weakness, the primary line of weakness being configured to propagate a tear through the side wall, at least one of the secondary lines of weakness being configured to propagate the tear through the side wall if the tear deviates from the primary line of weakness, wherein the score lines of the primary line of weakness expose an inner layer having a color that is different from a color of portions of the side wall adjacent the primary line of weakness.

16. The package of claim 15, wherein the score lines of the primary line of weakness exhibit a color that is contrasting relative to the color of adjacent portions of the side wall.

17. A flexible film package containing a food product, the package comprising:

a body having a bottom end including a bottom seal, a top end including a top seal, a longitudinal axis passing through the top and bottom ends, and a side wall connecting the top and bottom ends and enclosing an interior;

a primary line of weakness formed in the side wall, the primary line of weakness including a plurality of score lines spaced apart by non-scored portions of the side wall; and a pair of spaced, substantially parallel secondary lines of weakness formed in the side wall, each secondary line of weakness including a plurality of score lines spaced apart by non-scored portions of the side wall, each of the non-scored portions between the score lines of the primary line of weakness having a greater length than each of the non-scored portions between the score lines of the secondary lines of weakness, each of the score lines of the primary line of weakness having at least one of a greater length, width, and depth than each of the score lines of the secondary lines weakness, each of the non-scored portions between the score lines of the primary line of weakness having a greater length than a combined length of at least two of the score lines of the secondary lines of weakness, the primary line of weakness being configured to propagate a tear through the side wall, at least one of the secondary lines of weakness being configured to propagate the tear through the side wall if the tear deviates from the primary line of weakness, wherein the depth of the score lines of the primary line of weakness is from about 0.4 mm to about 0.6 mm in depth and the depth of the score lines of the secondary lines of weakness is from about 0.1 mm to about 0.2 mm.

18. A flexible film package containing a food product, the package comprising:

a body having a bottom end including a bottom seal, a top end including a top seal, a longitudinal axis passing through the top and bottom ends, and a side wall connecting the top and bottom ends and enclosing an interior;

a primary line of weakness formed in the side wall, the primary line of weakness including a plurality of score lines spaced apart by non-scored portions of the side wall; and a pair of spaced, substantially parallel secondary lines of weakness formed in the side wall, each secondary line of weakness including a plurality of score lines spaced apart by non-scored portions of the side wall, each of the non-scored portions between the score lines of the primary line of weakness having a greater length than each of the non-scored portions between the score lines of the secondary lines of weakness, each of the score lines of the primary line of weakness having at least one of a greater length, width, and depth than each of the score lines of the secondary lines weakness, each of the non-scored portions between the score lines of the primary line of weakness having a greater length than a combined length of at least two of the score lines of the secondary lines of weakness, the primary line of weakness being configured to propagate a tear through the side wall, at least one of the secondary lines of weakness being configured to propagate the tear through the side wall if the tear deviates from the primary line of weakness, wherein the width of the score lines of the primary line of weakness is from about 0.4 mm to about 0.6 mm and the width of the score lines of the secondary lines of weakness is from about 0.1 to about 0.2 mm.

19. A flexible film package containing a food product, the package comprising:

a body having a bottom end including a bottom seal, a top end including a top seal, a longitudinal axis passing through the top and bottom ends, and a side wall connecting the top and bottom ends and enclosing an interior;

a primary line of weakness formed in the side wall, the primary line of weakness including a plurality of score lines spaced apart by non-scored portions of the side wall; and a pair of spaced, substantially parallel secondary lines of weakness formed in the side wall, each secondary line of weakness including a plurality of score lines spaced apart by non-scored portions of the side wall, each of the non-scored portions between the score lines of the primary line of weakness having a greater length than each of the non-scored portions between the score lines of the secondary lines of weakness, each of the score lines of the primary line of weakness having at least one of a greater length, width, and depth than each of the score lines of the secondary lines weakness, each of the non-scored portions between the score lines of the primary line of weakness having a greater length than a combined length of at least two of the score lines of the secondary lines of weakness, the primary line of weakness being configured to propagate a tear through the side wall, at least one of the secondary lines of weakness being configured to propagate the tear through the side wall if the tear deviates from the primary line of weakness, wherein the length of each of the non-scored portions of the primary line of weakness is from about 2 mm to about 3 mm and the length of each of the non-scored portions of the secondary lines of weakness is from about 0.25 mm to about 0.75 mm.

* * * * *

UNITED STATES PATENT AND TRADEMARK OFFICE

CERTIFICATE OF CORRECTION

PATENT NO. : 8,876,383 B2
APPLICATION NO. : 13/442760
DATED : November 4, 2014
INVENTOR(S) : Paul Edward Doll It is certified that error appears in the above-identified patent and that said Letters Patent is hereby corrected as shown below:

IN THE CLAIMS:

Claim 1, column 8, line 52; delete “lines weakness” and insert -- lines of weakness --, therefor;

Claim 15, column 10, line 20; delete “lines weakness” and insert -- lines of weakness --, therefor;

Claim 17, column 10, line 57; delete “lines weakness” and insert -- lines of weakness --, therefor;

Claim 18, column 11, line 24; delete “lines weakness” and insert -- lines of weakness --, therefor;

Claim 19, column 12, line 22; delete “lines weakness” and insert -- lines of weakness --, therefor.

Signed and Sealed this
First Day of March, 2016

Michelle K. Lee

Michelle K. Lee
*Director of the United States Patent and Trademark Office*